United States Patent [19]

Baillargeon et al.

[11] 4,040,406

[45] Aug. 9, 1977

[54] IGNITION BREAKER POINT ARRANGEMENT

[75] Inventors: John L. Baillargeon, Springfield; Leonard W. Clifford, Wilbraham, both of Morocco

[73] Assignee: Eltra Corporation, Toledo, Ohio

[21] Appl. No.: 538,648

[22] Filed: Jan. 6, 1975

[51] Int. Cl.[2] ..... F02P 1/00; H01H 19/62

[52] U.S. Cl. ..... 123/146.5 A; 200/30 A; 200/30 AA

[58] Field of Search ..... 123/146.5 A; 200/30 A, 200/30 AA

[56] References Cited

U.S. PATENT DOCUMENTS

| | | | |
|---|---|---|---|
| 1,985,573 | 12/1934 | Mallory | 200/30 A |
| 2,752,436 | 6/1956 | Phelon | 200/30 A |
| 2,755,348 | 7/1956 | Phelon | 200/30 A |
| 2,847,490 | 8/1958 | Phelon | 123/149 D |
| 2,847,524 | 8/1958 | Slick | 200/30 A |
| 2,851,546 | 9/1958 | Phelon et al. | 200/30 A |
| 2,953,652 | 9/1960 | Johnson | 200/30 A |

*Primary Examiner*—Carroll B. Dority, Jr.
*Assistant Examiner*—David D. Reynolds
*Attorney, Agent, or Firm*—Robert E. Greenstien

[57] ABSTRACT

A pair of breaker contacts are opened and closed by the pivotal movement of a breaker lever carrying one of the breaker contacts for engagement with the other breaker contact which is stationary. The breaker lever is pivotally supported on an upright pivot post which is formed integrally with a cupshaped container constructed from an inexpensive plastic material, and the end of the pivot post is received in a reinforced opening of a cover member secured to the cup-shaped container so as to prevent the pivot post from being undesirably deflected during the pivotal movement of the breaker lever.

2 Claims, 3 Drawing Figures

IGNITION BREAKER POINT ARRANGEMENT

Figure 1:
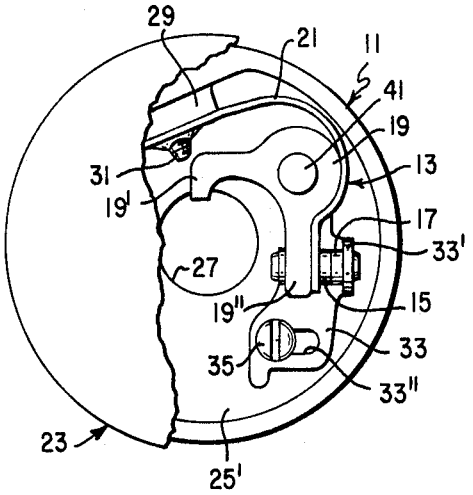

This invention relates to an ignition system for a small internal combustion engine, and more particularly to a breaker point assembly for a magneto ignition system.

In an ignition system for a small internal combustion engine, such as a one-cylinder engine used to drive a small chain saw, the ignition pulses for operating the engine may be produced in response to the opening and closing of a pair of breaker points in timed relation with the operation of the engine. One of the breaker points is supported for movement on an arm of a breaker lever and resiliently biased against the other breaker point which is stationary, and the breaker points are opened and closed by the movement of the breaker lever in association with the operation of the engine. Typically, the breaker lever is pivotally supported on an upright pivot post while the stationary breaker point is mounted on a turned-up ear of a metal breaker plate, and the breaker point arrangement may be mounted in a box for easy assembly with the engine.

The breaker point arrangement must operate satisfactorily for a minimum period of time in an environment subject to substantial variations in temperature and humidity, and to minimize the friction associated with the movement of the breaker lever the pivot post is constructed from a suitable bearing material. In a conventional arrangement, the pivot post is constructed from brass and staked to the metal breaker plate, and the box enclosing the breaker point arrangement is constructed from a suitable inexpensive plastic material. However, such an arrangement has not been altogether satisfactory because the staked pivot post has never been sufficiently rigid to prevent deflection during the pivotal movement of the breaker lever causing undesirable wear of the breaker points.

With the advent of smaller, less expensive chain saws requiring a substantially reduced period of satisfactory operation, it is desirable to provide a less expensive ignition system. Since a separate manufacturing operation is required to stake the pivot post to the breaker plate, a reduction in the cost of the ignition system could be achieved by constructing the pivot post integrally with another member. In the past, as shown in U.S. Pat. No. 2,912,608, the pivot post has sometimes been formed integrally with the box enclosing the breaker point arrangement when the box was cast from a suitable metal, for example zinc. However, a metal breaker box is too expensive and heavy for use with a small, lightweight and inexpensive chain saw. Although it would be desirable to form the pivot post integrally with a box constructed from an inexpensive plastic material, nevertheless such a pivot post would undergo too much deflection resulting in undesirable wear on the breaker points.

Accordingly, an object of the present invention is to provide a lightweight, inexpensive breaker point assembly for use with a small and inexpensive chain saw.

Another object of the invention is to provide a breaker point assembly with an inexpensive pivot post supporting a breaker lever for pivotal movement without being undesirably deflected.

Figure 2:
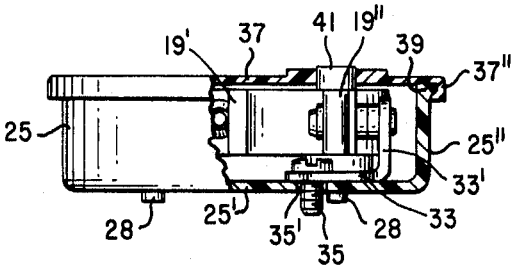
Figure 3:
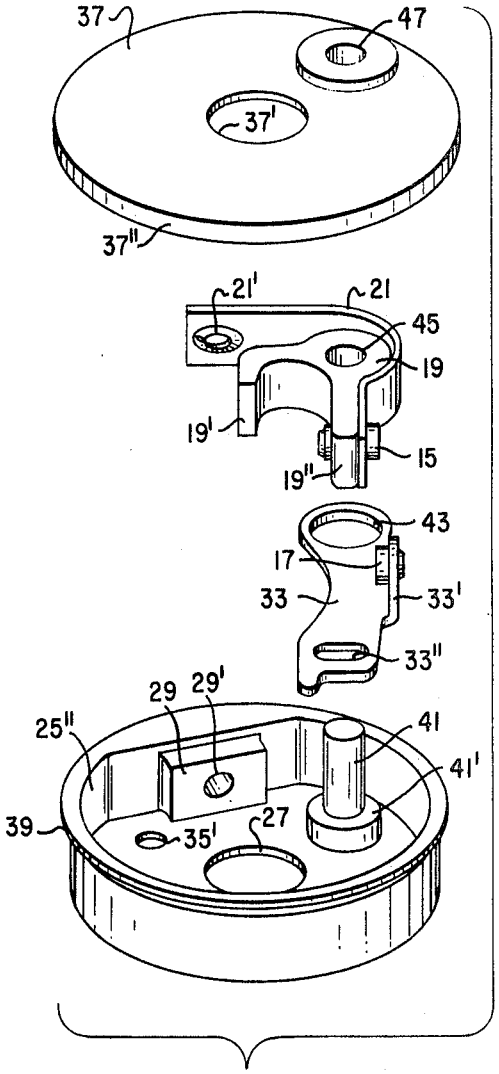

Still other objects, features and advantages of the present invention will become apparent to those skilled in the art from a reading of the following detailed description of the invention, taken in conjunction with the accompanying drawing, wherein:

FIG. 1 is a diagrammatic plan view of a breaker point assembly constructed in accordance with the present invention and having a portion of a breaker box cut away to illustrate the breaker point arrangement, FIG. 2 is a diagrammatic side view of the breaker point assembly having a portion of the breaker box cut away to illustrate the mounting of the breaker lever, and FIG. 3 is a partial exploded view of the breaker point assembly.

Referring now in detail to the figures in the drawing, and more particularly to FIG. 1, there is shown a breaker point assembly, generally indicated 11, for a magneto ignition system which is operated to supply ignition pulses to a small internal combustion engine, not shown. As is conventional, the magneto ignition system includes an ignition coil, not shown, having a primary winding which is connected in circuit with a breaker point means, generally indicated 13, for controlling the energization of the ignition coil to effect ignition pulses in a secondary winding. An energizing current may be induced in the ignition coil by a permanent magnet rotating with a flywheel, not shown, which is mounted on the end of an engine crankshaft, and the energization of the primary winding is effected through a pair of cooperating breaker contacts 15 and 17.

One of the breaker contacts 15 is carried on a breaker lever 19 movable about a pivot axis and urged by a spring 21 against the other breaker contact 17 which is stationary, and the ignition pulses are produced in response to the opening and closing of the breaker contacts 15 and 17 in accordance with the movement of a cam, not shown, which may be mounted on the engine crankshaft for acting against the breaker lever 19. To facilitate the assembly of the magneto ignition system in combination with the associated engine, the breaker point means 13 are enclosed in a breaker box means, generally indicated 23, which also serves to exclude undesirable elements such as sawdust. The details of the magneto ignition system and the engine have not been shown since they form no part of the invention and may be desirably conventional.

As shown, the breaker point means 13 is arranged inside the breaker box means 23 which includes support means in the form of a cylindrical cup-shaped container 25 having an axial opening 27 formed in a bottom wall 25' through which the end of the crankshaft is received as the container 25 is placed on the engine casing, and the container 25 is positioned concentrically with the axis of the crankshaft by a pair of pins 28 which project downwardly from the bottom wall 25' for receipt in a pair of corresponding positioning holes in the engine casing. The breaker lever 19 is generally L-shaped with an arm 19' serving as a cam follower for engaging the cam mounted on the crankshaft and with another arm 19'' carrying the breaker contact 15. The spring 21 urging the breaker contact 15 against the stationary breaker contact 17 is in the form of a leaf spring which is clamped to the arm 19'' of the breaker lever 19 by the mounting of the breaker contact 15 and secured to an abutment 29 on a side wall 25'' of the cup-shaped container 25 by a threaded screw 31 which is received through bore 29' and screwed into a threaded opening 21' formed in the spring 21.

The stationary breaker contact 17 is mcunted on a turned-up ear 33' of a breaker plate 33 which is movable about the pivot axis of the breaker lever 19 for adjusting the timing of the ignition pulses and the position of the breaker plate 33 may be fixed by a threaded screw 35 which is received through an elongated opening 33'' in the breaker plate 33. The threaded screw 35 is one of a pair of screws which are received through openings 35' in the bottom wall 25' and screwed into threaded openings in the engine casing to secure the breaker point assembly 11 to the engine. The breaker point means 13 is then enclosed inside the breaker box means 23 which includes cover means in the form of a cylindrical-shaped cover 37 with an axial opening 37' through which the end of the crankshaft is received for mounting the flywheel and having an annular flange 37'' for being snap-fitted onto a rounded lip 39 of the cup-shaped container 25.

The breaker plate 33 may be constructed from a suitable electrically conductive material such as steel, and the spring 21 may be constructed from stainless steel. The L-shaped breaker lever 19 may be constructed from a suitable electrically insulating material such as a thermoset phenolic or a thermoplastic such as polyester or nylon with about thirty percent glass filler for rigidity. Similarly, the cup-shaped container 25 may be constructed from an electrically insulating thermoplastic material such as polyester or nylon with about thirty percent glass filler. The cover member 37 which is snap-fitted onto the cup-shaped container 25 may be more flexible than the container 25 and constructed from a suitable electrically insulating thermoplastic material such as a polyester or acetal without any glass filler.

As previously described, the ignition pulses are produced in response to the opening and closing of the breaker contacts 15 and 17 which is effected by the pivotal movement of the breaker lever 19 about a pivot axis which, as shown in FIG. 3, is provided by pivot means in the form of an upright pivot post 41. In accordance with the present invention, the cost of manufacturing the breaker point assembly 11 is minimized by forming the pivot post 41 integrally with the cup-shaped container 25 which, as previously mentioned, is constructed from an inexpensive plastic material. As shown in FIG. 3, the breaker plate 33 and the breaker lever 19 have openings 43, 45 respectively, for receiving therethrough the upright pivot post 41 with the opening 43 in the breaker plate 33 being sufficiently large to also receive a collar 41' formed on the pivot post 41 to vertically space the breaker lever 19 from the breaker plate 33. To prevent the pivot post 41 from being undesirably deflected during the pivotal movement of the breaker lever 19, the pivot post is additionally secured to the cylindrical cover 37 which is snap-fitted onto the cup-shaped container 25. As more particularly shown in FIG. 2, the upright pivot post 41 extends upwardly beyond the side wall 25'' of the cup-shaped container 25, and the end of the pivot post 41 is received through an opening 47 formed in a reinforced portion of the cylindrical cover 37.

What is claimed is:

1. A breaker point assembly for a magneto ignition system comprising:

breaker box means for being mounted on an engine having a shaft rotatable in association with the operation of the engine and carrying a cam, breaker point means mounted in said breaker box means for effecting ignition pulses in response to the rotational movement of the cam carried by the engine shaft, said breaker box means including support means having a wall with an opening therethrough for receiving the engine shaft and cover means removably secured to said support means for enclosing the breaker point means, said breaker point means including a breaker lever for movement about a pivot axis and having an arm carrying a contact mounted on said support means and another arm for engaging the cam carried by the rotational engine shaft, and a pivot post constructed integrally with said support means, secured to the wall of said support means and providing an axis for the pivotal movement of said breaker lever, said cover means including a wall with an openings formed therein for receiving and holding the end of said pivot post upon being removably secured to said support means.

2. A breaker point assembly for a magneto ignition system, comprising:

breaker box means for being mounted on an engine having a shaft rotatable in association with the operation of the engine and carrying a cam, breaker point means mounted in said breaker box means for effecting ignition pulses in response to the rotational movement of the cam carried by the engine shaft, said breaker box means including support means having a wall with an opening formed therethrough for receiving the engine shaft and cover means removably secured to said support means for enclosing the breaker point means, said breaker point means including a breaker lever for movement about a pivot axis and having an arm carrying a breaker contact for being urged against a stationary breaker contact mounted on said support means and another arm for engaging the cam carried by the rotatable engine shaft, pivot means providing an axis for the pivotal movement of said breaker lever and being secured to the wall of said support means and to said cover means, said pivot means being in the form of an upright pivot post constructed integrally with said support means, said breaker lever having a bore formed therein for receiving said upright post therethrough, said cover means including a wall with an opening formed therein for receiving the end of said upright post upon being removably secured to said support means, said support means being in the form of a cup-shaped container constructed from a plastic material, and said cover means being in the form of a cover member adapted to be snap-fitted onto said cup-shaped container.

* * * * *